US009770155B2

(12) United States Patent
Da Pont et al.

(10) Patent No.: US 9,770,155 B2
(45) Date of Patent: Sep. 26, 2017

(54) COMPONENT FOR FEEDING A PRESSURIZED LIQUID TO A WASHING TUB OF A WASHING MACHINE, IN PARTICULAR A DISHWASHER

(71) Applicant: ELBI INTERNATIONAL S.p.A., Italy (IT)

(72) Inventors: Paolo Da Pont, Collegno (IT); Paolo Chiapello, Collegno (IT); Luca Garetto, Collegno (IT); Paolo Ravedati, Collegno (IT); Pietro Villani, Collegno (IT)

(73) Assignee: ELBI INTERNATIONAL SPA, Turin (IT)

( * ) Notice: Subject to any disclaimer, the term of this patent is extended or adjusted under 35 U.S.C. 154(b) by 355 days.

(21) Appl. No.: 14/376,348

(22) PCT Filed: Dec. 27, 2012

(86) PCT No.: PCT/IB2012/057742
§ 371 (c)(1),
(2) Date: Aug. 1, 2014

(87) PCT Pub. No.: WO2013/114168
PCT Pub. Date: Aug. 8, 2013

(65) Prior Publication Data

US 2015/0013733 A1 Jan. 15, 2015

(30) Foreign Application Priority Data

Feb. 1, 2012 (IT) ..... TO2012A0082

(51) Int. Cl.
*A47L 15/42* (2006.01)
*D06F 39/08* (2006.01)

(52) U.S. Cl.
CPC ..... *A47L 15/4214* (2013.01); *A47L 15/4217* (2013.01); *D06F 39/083* (2013.01); *Y10T 137/87169* (2015.04)

(58) Field of Classification Search
CPC ..... B08B 3/00
See application file for complete search history.

(56) References Cited

FOREIGN PATENT DOCUMENTS

| | | |
|---|---|---|
| DE | 87 03 731 | 4/1987 |
| EP | 0 612 495 | 8/1994 |
| EP | 2 377 450 | 10/2011 |

OTHER PUBLICATIONS

Heidel et al., Oct. 2011, EP 2377450, English machine translation.*

(Continued)

*Primary Examiner* — Jason Ko
(74) *Attorney, Agent, or Firm* — Merchant & Gould P.C.

(57) ABSTRACT

The component (10) comprises a hollow body (12) having: an inlet (14, 14*a*, 14*b*), which is adapted to be connected to a source of pressurized liquid, for example the water supply network (WS); an outlet (16), adapted to deliver said liquid to a washing chamber (WC) defined by said washing tub (WT); a path (18) for the liquid, which is defined in the hollow body (12) between the inlet (14, 14*a*, 14*b*) and the outlet (16) and includes anti-return means (26, 26*a*) for said liquid under pressure; a passage (28), adapted to receive, at its inlet, vapor coming from the washing chamber (WC) and to discharge the vapor into the environment outside of the washing tub (WT); and a valve device (30) comprising a plug element (32), adapted to at least partially free and obstruct said passage (28).

12 Claims, 6 Drawing Sheets

(56) References Cited

OTHER PUBLICATIONS

International Search Report for International Application No. PCT/IB2012/057742 mailed May 6, 2013 (2 pages).

* cited by examiner

COMPONENT FOR FEEDING A PRESSURIZED LIQUID TO A WASHING TUB OF A WASHING MACHINE, IN PARTICULAR A DISHWASHER

TECHNICAL FIELD

The present invention is relative to a component for feeding a pressurized liquid to a washing tub of a washing machine, in particular for a dishwasher.

More in detail, the present invention is relative to a component according to the preamble of appended claim 1.

TECHNOLOGICAL BACKGROUND

In the field of washing machines, components are widely known to be used to feed a pressurized liquid to the washing tub of a washing machine, for example a dishwasher. Typically, the above-mentioned components are mounted outside the washing tub, for example on the external face of one of its lateral walls.

First of all, these components are provided with a device, adapted to prevent the liquid used from flowing back to the water supply network due to a reflux caused by a sudden pressure drop. By way of example, this device is represented by an "air break" section (also called "air gap" section), which consists of an interruption, which is obtained in the path that leads the liquid at atmospheric pressure into the component.

Furthermore, the above-mentioned components generally fulfill the function of connecting the inside of the washing tub to the external environment, so as to maintain a pressure balance between the external environment and the washing tub, i.e. so as to cause the possible overpressures or vacuums that may occur inside the washing tub during the operation of the washing machine to be brought back to the external pressure. As a matter of fact, during the operation of the washing machine, the pressure in the washing tub can assume anomalous values, which may jeopardize the operation of the washing machine itself or, in case of overpressure, can be dangerous for the user. In order to avoid this situation, said components typically have a passage, which adapted to establish a connection between the washing tub and the external environment and to discharge the vapor received towards the environment outside of the washing tub itself.

The components known from the prior art, though, have some drawbacks.

One drawback consists in the fact that, in case industrial washing machines are used, which, for example, are specifically developed for the medical field, the inner environment of the washing tub needs to be controlled, so as to avoid contamination by the external environment.

SUMMARY OF THE INVENTION

The object of the present invention is to provide a components of the type described above, which is able to solve this and other drawbacks of the prior art and which, at the same time, can be produced in a simple and economic fashion.

Another object of the present invention is to provide a component of the type described above, which can be used not only in the technical field of washing machines for domestic used, but also in the technical field of industrial washing machines and in all those technical fields where the inner environment of the washing tub needs to be controlled, for example so as to reduce the risk of contamination by the external environment.

According to the present invention, this and other objects are reached by means of a component having the features set forth in appended claim 1.

The appended claims are an integral part of the technical teachings provided in the description with reference to the present invention.

BRIEF DESCRIPTION OF THE DRAWINGS

Further features and advantages of the present invention will be best understood upon perusal of the following detailed description, which is provided by way of example and is not limiting, with reference to the accompanying drawings, which specifically illustrate what follows.

DETAILED DESCRIPTION OF THE INVENTION

Figure 1:
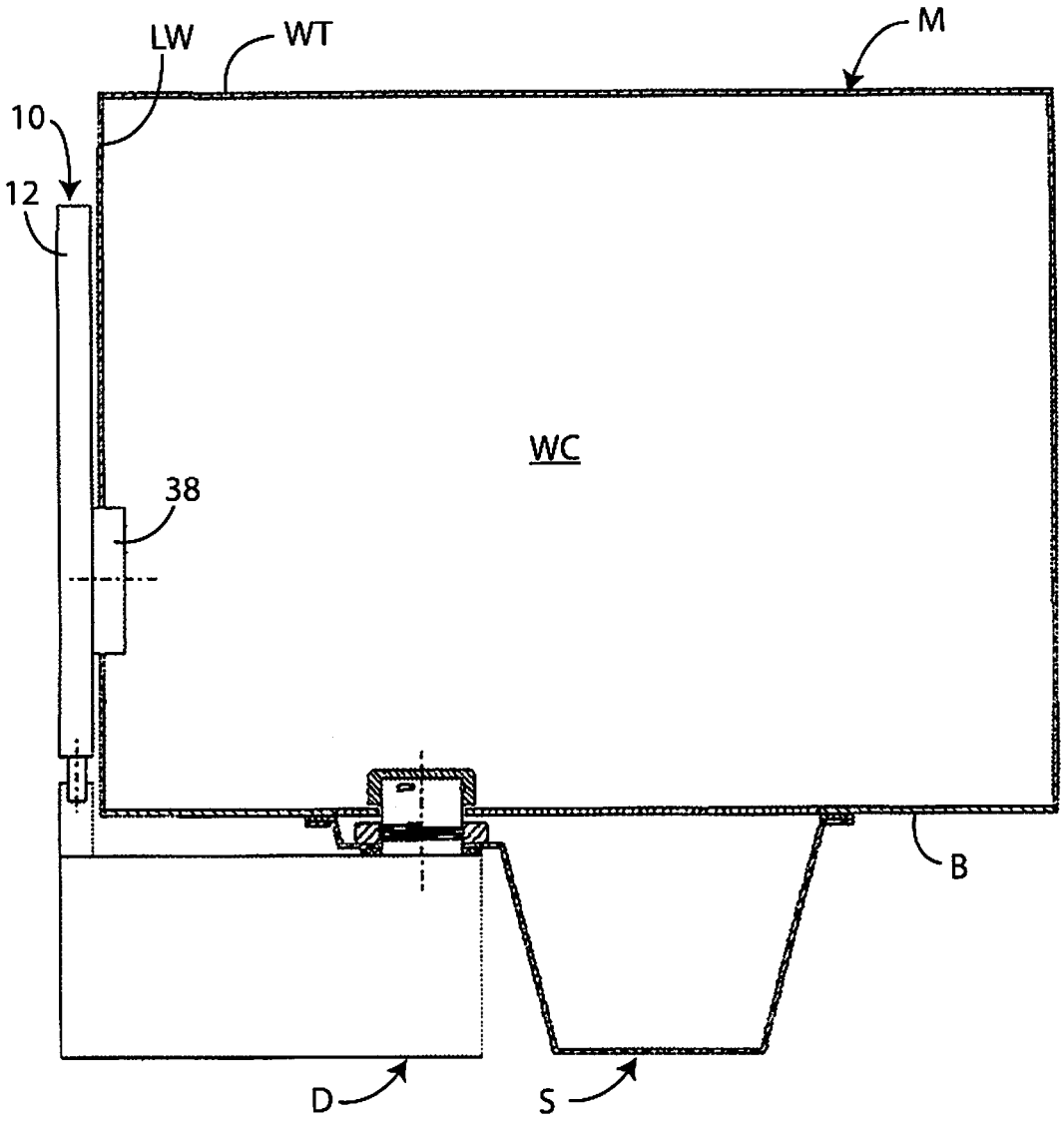
FIG. 1 is a schematic view in front elevation and in cross-section, which shows a washing machine, which comprises, in its inside, a component for feeding a liquid according to an explanatory embodiment of the present invention.

With reference, in particular, to FIG. 1, indicates, as a whole, a washing machine, which comprises a component 10 according to an explanatory embodiment of the present invention. Component 10 is used to feed a liquid, such as water, to a washing tub of washing machine M.

In the embodiment shown in the figures, washing machine M is a dishwasher. Component 10, though, can also be used in other types of washing machines, for instance in a washing machine for clothes.

Washing machine M comprises a washing tub WT, which defines, in its inside, a washing chamber WC and on whose bottom B there are provided, for example, a decalcifier D, adapted to adjust the hardness of the water flowing in, and a sump S, adapted to collect the washing liquid coming from washing chamber WC.

Component 10 is preferably mounted on a lateral wall LW of washing tub WT, for example in correspondence to an external face of its.

Figure 2:
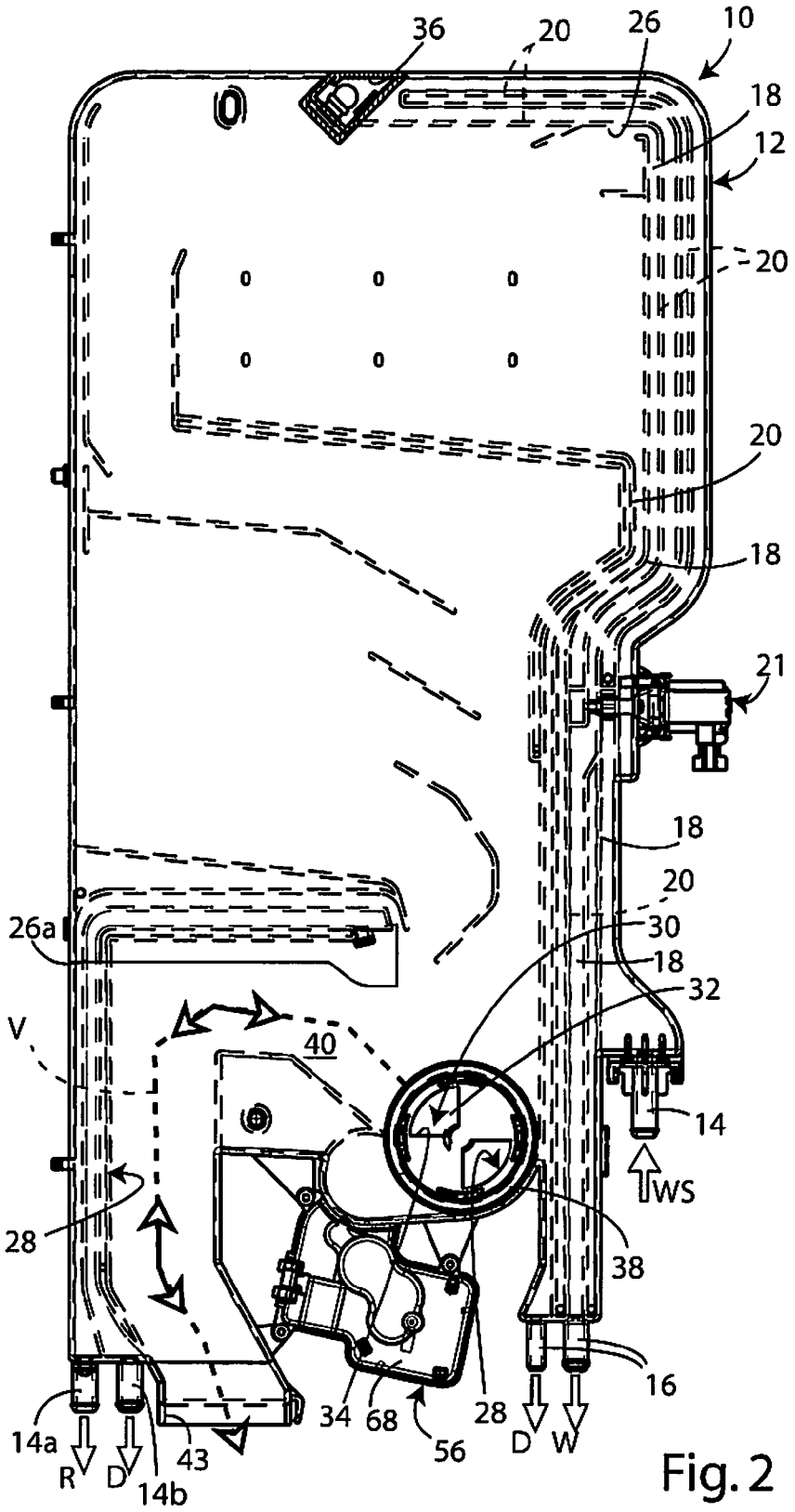
FIG. 2 is a view in elevation, which shows the component of the previous figure and, in transparency, the paths for the liquid and the passage for a fluid, which are obtained in said component.
Figure 3:
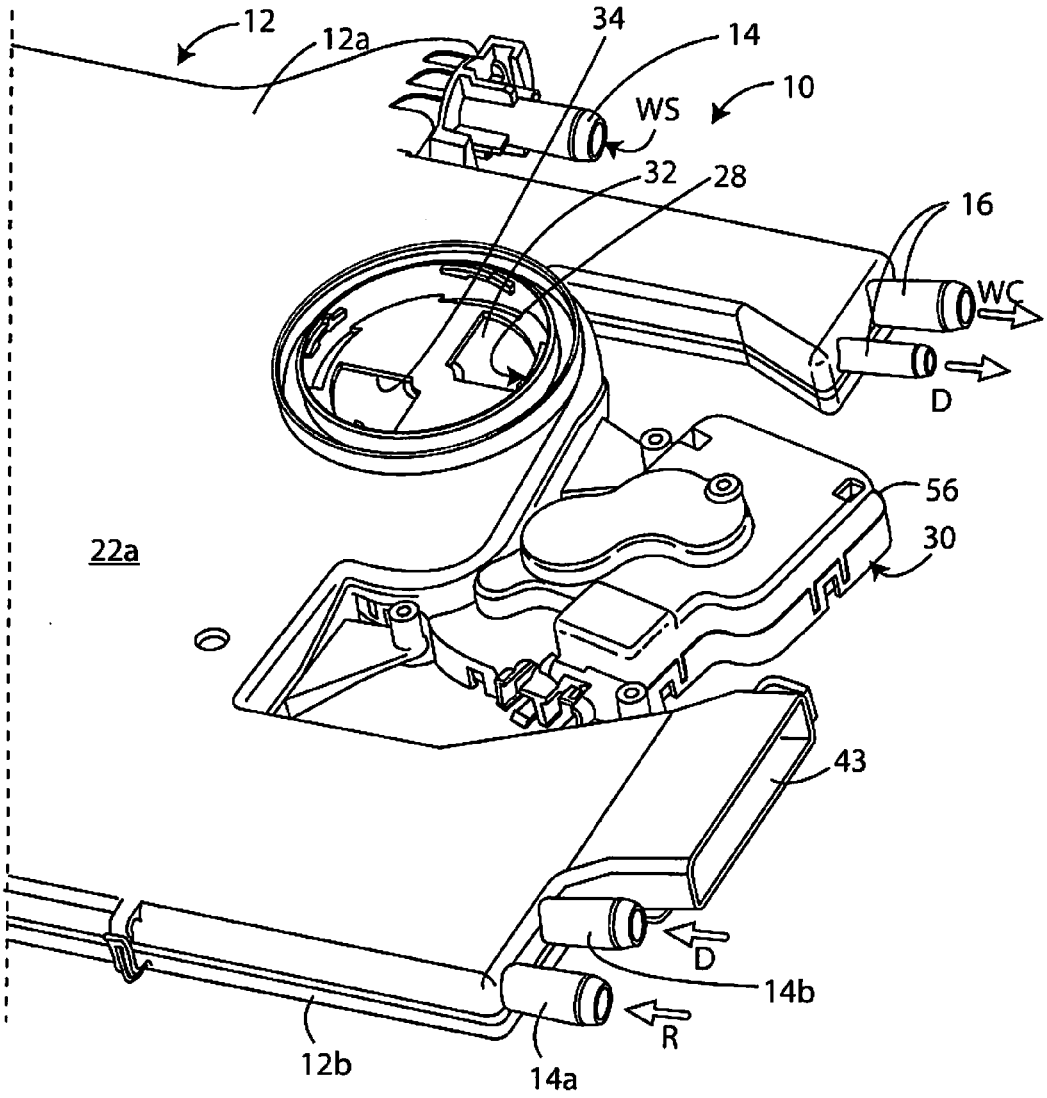
FIG. 3 is a partial prospective view of the component shown in the previous figures.

With reference, in particular, to FIGS. 2 and 3, component 10 comprises a hollow body 12 having at least one inlet 14, adapted to be connected to a source of liquid under pressure, such as water coming from the water supply network WS, and at least one outlet 16, adapted to convey the liquid towards washing tub WT.

In the embodiment shown, hollow body 12 has an inlet 14, which is connected to water supply network WS, for example by means of a solenoid valve (not shown). In the embodiment shown, hollow body 12, has a pair of outlets 16, of which, for example, one directly communicates with washing chamber WC, while the other one communicates with the inlet of possible decalcifier D.

With reference, in particular, to FIG. 2, a path 18 for the above-mentioned liquid under pressure is defined in hollow body 12 between inlet 14 and outlet 16. In the embodiment shown, path 18 is defined by a sequence of hollow spaces, which are obtained between pairs of ribs 20, which are obtained in hollow body 12 and form, in its inside, a continuous channeling.

In the embodiment shown, component 10 comprises, furthermore, a possible diverter valve 21, adapted to hydraulically connect, in a controlled and selective manner, inlet 14 to outlets 16.

Figure 4:
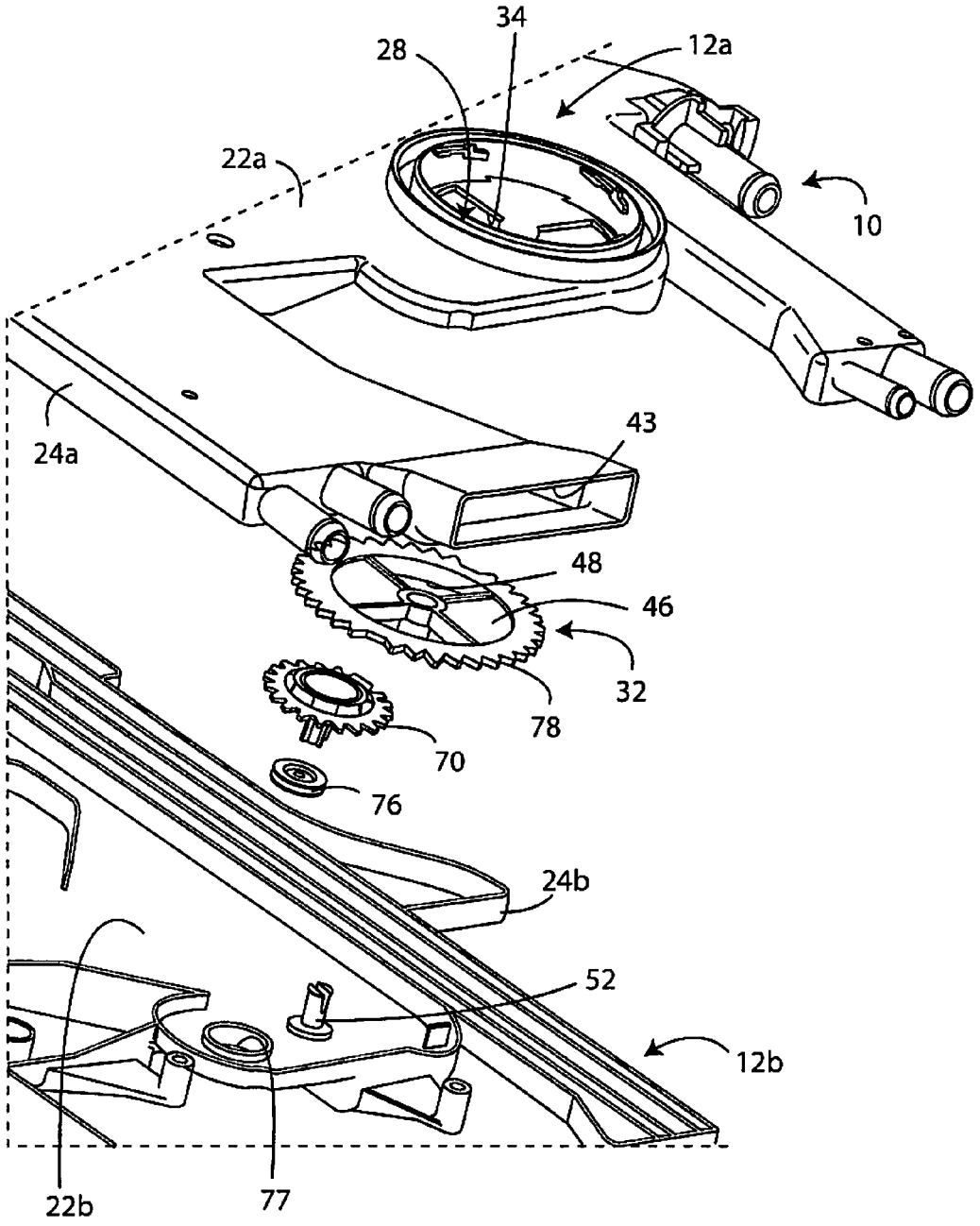
FIG. 4 is a partial prospective view, in an exploded drawing, of the component shown in the previous figures, which shows a part of a valve device.
Figure 5:
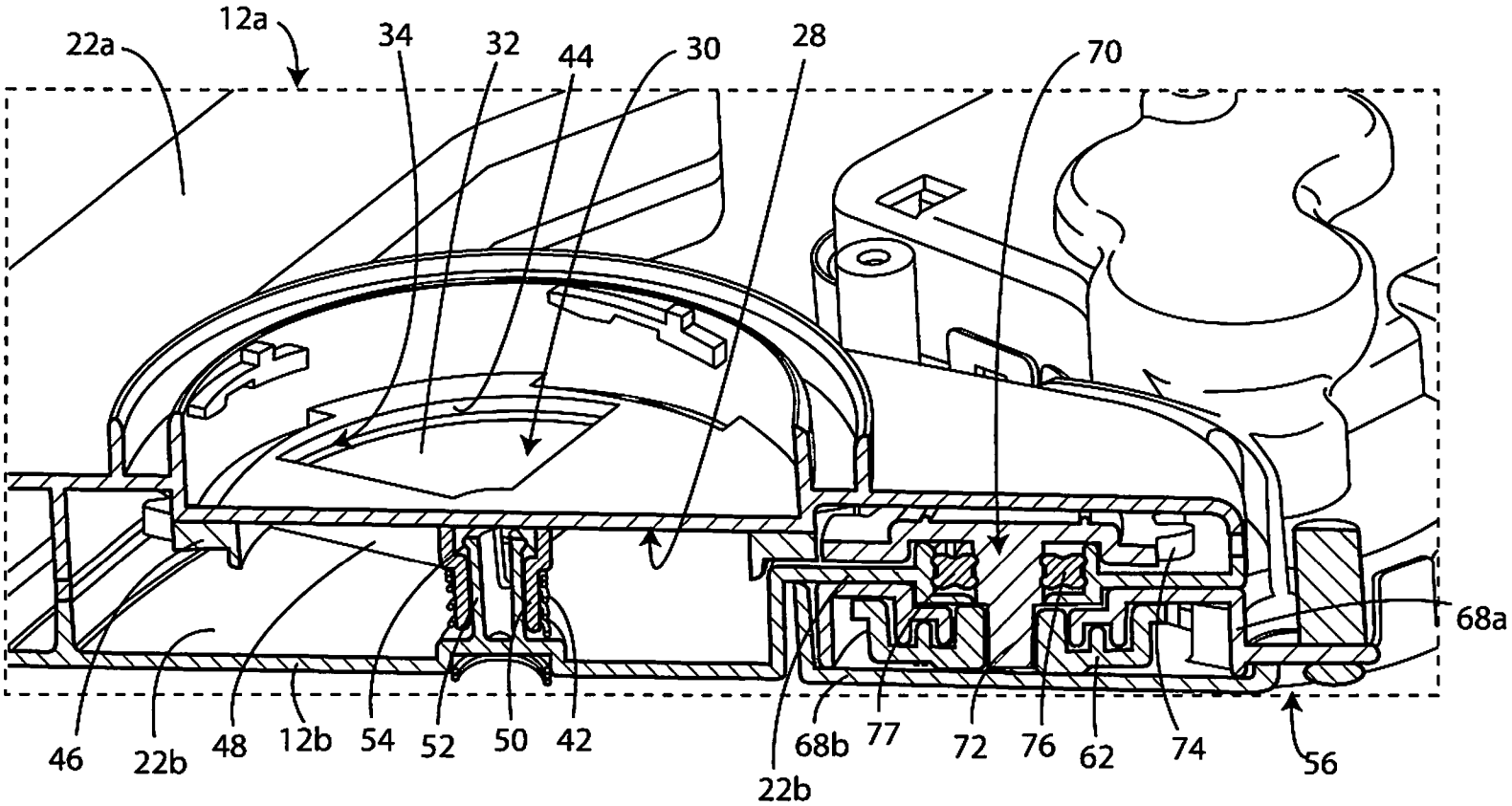
FIG. 5 is a partial prospective view, in section, of the component shown in the previous figures, which shows the valve device of FIG. 4.
Figure 6:
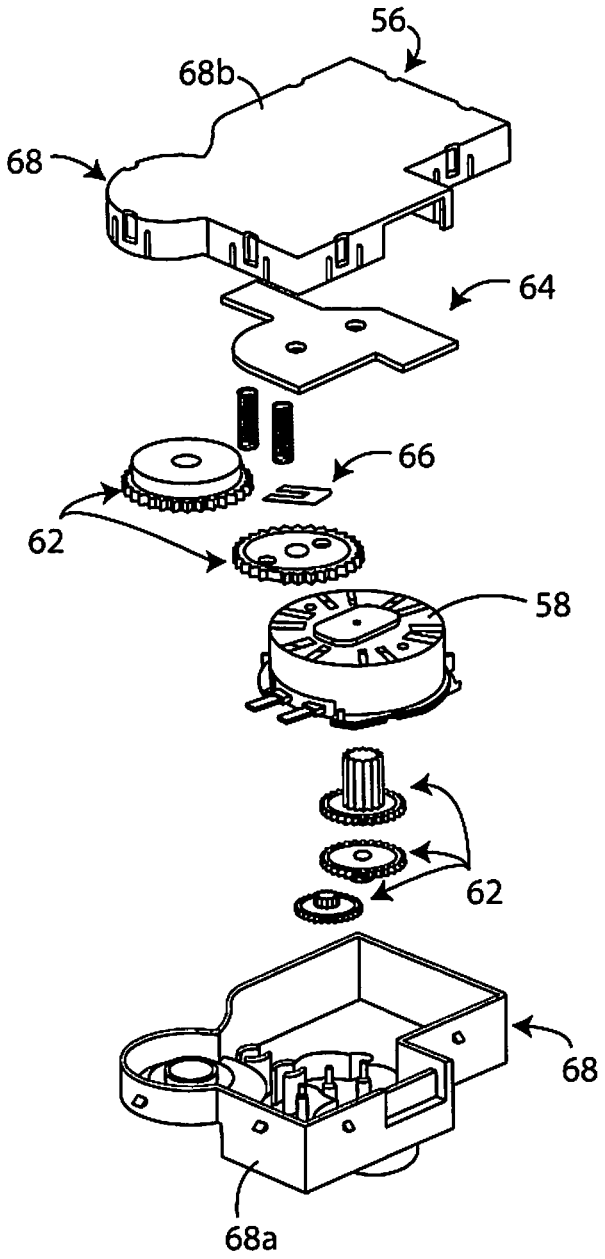
FIG. 6 is a prospective view, in an exploded drawing, of the valve device shown in FIGS. 4 and 5.

Preferably, hollow body 12 is made by a pair of shaped half-shells 12*a*, 12*b*, which are coupled to one another in a fluid-tight manner. With reference, in particular, to FIGS. 4 and 5, shaped half-shells 12*a*, 12*b* preferably have respective main superficial extension faces or bottoms 22*a*, 22*b* and respective minor peripheral superficial extension walls or profiles 24*a*, 24*b*. In the embodiment shown, ribs 20 are defined by peripheral walls and/or shaped projections, which protrude from bottom 22*a* and 22*b* of respective half-shells 12*a* and 12*b*. Advantageously but not necessarily, half-shells 12*a* and 12*b* are manufactured with a plastic material, for example by means of injection molding, and are coupled to one another by means of a hot plate welding procedure.

With reference, in particular, to FIG. 2, path 18 comprises anti-return means, so as to avoid a reflux of the liquid in the direction of inlet 14. Preferably, the anti-return means comprise at least one air break section 26 and 26*a*. In the embodiment shown, the anti-return means comprise, furthermore, at least one anti-reflux device 36.

In particular, the structure and the shape of path 18 is shown only by way of example. As a matter of fact, as a person skilled in the art would known, path 18 can be shaped in many different ways and, in order to connect inlet 14 to outlet 16, it can comprise ways and courses that are different from those shown in the figures. In further embodiments that are not shown, path 18 can lead to a plurality of different outlets and/or it can receive the liquid from a plurality of further different inlets.

By mere way of example, component 10 can have a further inlet 14*a* for the connection, by means of a solenoid valve (not shown), to another type of water supply (for example an external tank R), and another inlet 14*b* for feeding the water coming from the outlet of decalcifier D. Both inlets 14*a* and 14*b* end in a common receptacle 40 by means of an air break section 26*a*, which is arranged downstream thereof.

According to further embodiments of the present invention, path 18 can communicate with other receptacles that are obtained in hollow body 12 and, in turn, can be selectively connected to a tank containing resins with decalcifying properties and/or to a tank containing salt for the regeneration of the above-mentioned resins (these details not being shown in the figures). In other embodiments that are not shown, path 18 can allow the liquid to be selectively introduced into one or more chambers, which are obtained in hollow body 12 and selectively communicate with washing chamber WC and/or with outlets 16 and/or with air break sections 26 and/or 26*a*. These detailed aspects of component 10 are known to a person skilled in the art. Therefore, for the sake of brevity, they will not be described in detail hereinafter.

With reference, in particular, to FIGS. 2 and 3, hollow body 12 has, furthermore, a passage 28, which is adapted to establish a fluid communication, through hollow body 12, between washing chamber WC and the environment outside of washing tub WT, thus causing them to reach a pressure balance. For example, in case an overpressure occurs in washing chamber WC, passage 28 is adapted to receive, at its inlet, vapor coming from washing chamber WC, so as to discharge said vapor into the external environment. On the other hand, in case a vacuum occurs in washing chamber WC, the passage is adapted to receive air from the environment outside of washing tub WT and to introduce it into washing chamber WC, so as to compensate said vacuum.

By way of example, broken arrow V indicates the path that a fluid can follow inside hollow body 12 through passage 28.

With reference, in particular, to FIGS. 4 and 5, component 10 comprises, furthermore, a valve device 30 comprising a plug element 32, adapted to at least partially free and obstruct passage 28. In this way, one can control and/or adjust the fluid communication, in particular of air or vapor, between the inside of washing chamber WC and the environment outside of washing tub WT and even completely separate the two environments. This aspect is particularly advantageous and appreciated in the case of washing machines M used in the industrial field and, more specifically, for the applications in the medical field, where the contaminations between the inside of washing chamber WC and the environment outside of washing tub WT, which are caused for example by the passage of vapor, need to be minimized.

Preferably, passage 28 has at least one orifice 34, adapted to establish a fluid communication between washing chamber WC and the inside of hollow body 12. In particular, in case of an overpressure in washing chamber WC, orifice 34 is able to receive, at its inlet, vapor coming from washing chamber WC. Furthermore, passage 28 comprises at least one hole 43 (FIG. 2), adapted to establish a fluid communication between the inside of hollow body 12 and the environment outside of washing tub WT. In particular, in case of an overpressure in washing chamber WC, hole 43 is able to discharge said vapor into the environment outside of washing tub WT.

In the embodiment shown, plug element 32 is adapted to at least partially free or obstruct orifice 34. An advantage that is associated with the above-mentioned feature consists in the fact that plug element 32 stops the fluid communication, through passage 28, between hollow body 12 and washing chamber WC. In this way the risk of possible contaminations is further reduced.

Preferably, orifice 34 is obtained through bottom 22*a* of half-shell 12*a*. Preferably, on the other hand, hole 36 is obtained in correspondence to profile 24*a* or 24*b* of half-shell 12*a* or of half-shell 12*b* respectively.

In the embodiment shown, orifice 34 leads into washing chamber WC through lateral wall LW. For example, a ring nut 38 (FIG. 1) can be applied on orifice 34, said ring nut 38 extending through lateral wall LW an allowing component 10 to be mounted on washing tub WT.

Advantageously but not necessarily, with reference to FIGS. 2 and 5, passage 28 has a receptacle 40, which is arranged between orifice 34 and hole 43. Receptacle 40 also acts, for passage 28, as a condensation chamber, in which, in case an overpressure occurs in washing chamber WC, the vapor entering from orifice 34 can liquefy and flow out from hole 43.

Preferably, the receptacle 40 has an upstream portion, which is substantially transverse and communicates with orifice 34, and a downstream portion, which is substantially descending and is arranged between said upstream portion and hole 43.

Preferably, receptacle 40 is shared by passage 28 and at least one of the paths for the liquid obtained in hollow body 12. In the embodiment shown, said path for the liquid starts with inlets 14*a*, 14*b*, which flow into receptacle 40, and ends in orifice 34 of passage 28. In this way, a liquid flow coming from the further source of water under pressure (e.g. tank R) or from decalcifier D can flow into inlet 14*a* or into inlet 14*b* respectively, flow through air break 26*a*, which is arranged downstream thereof, access the upstream portion of receptacle 40 and flow out of orifice 34, thus reaching washing chamber WC.

In the embodiment shown, plug element 32 is mounted so as to be movable inside hollow body 12. An advantage that is associated with the above-mentioned feature consists in the fact that a component 10 that is provided with valve device 30 can be manufactured by substantially keeping the same dimensions as a component according to the prior art.

Preferably, plug element 32 is mounted so as to rotate with respect to hollow body 12. In the embodiment shown, plug element 32 is guided, during its rotation, by portions that are supported by the internal faces of respective bottoms 22*a*, 22*b* of half-shells 12*a*, 12*b* (see FIG. 5). In this way, its movement inside hollow body 12 is more reliable and precise.

With reference, in particular, to FIG. 5, plug element 32 is preferably axially held against orifice 34 by means of an elastic thrust member (42), for example a compression-loaded helical spring. An advantage that is associated with the above-mentioned feature consists in that fact that there is an improvement in the fluid-tight seal between orifice 34 and plug element 32.

Preferably, orifice 34 has at least one shaped opening 44, adapted to be flown through by vapor. More preferably, shaped opening 44 has the shape of a circular sector, for example of approximately 90°. An advantage that is associated with the above-mentioned feature consists in the fact that the shape of opening 44, together with the rotatory plug element 32, allows an effective adjustment of the working surface of the opening that connects hollow body 12 to washing chamber WC.

In the embodiment shown, orifice 34 has a pair of openings 44, which are arranged according to a central symmetry. For example, each one of openings 44 has the shape of a circular sector of magnitude of approximately 90°.

Preferably, plug element 32 comprises a plug disc 46 having one or more shaped slits 48, which are associated to openings 44 and define, in turn, a shape that substantially corresponds to the above-mentioned shape delimited by orifice 34. An advantage that is associated with the above-mentioned features consists in the fact that the structure of disc 46 gives robustness and reliability to plug element 32 while fulfilling its function of freeing and obstructing openings 44.

According to the operating mode of component 10, when plug element 32 is rotated in such a way that shaped slits 48 coincide with shaped openings 44, the complete opening of orifice 34 is allowed. On the other hand, when plug element 32 is rotated in such a way that shaped slits 48 are completely covered, a complete closing of orifice 34 is obtained. Optionally, intermediate adjustment positions can be used, in which the plug element is rotated to such a position that the slits are only partially arranged on top of shaped openings 44.

Optionally, plug element 32 has an internally hollow axial hub 50, in which disc 46 converges towards the inside. In the embodiment shown, half-shell 12*b* has a pin 52 projecting from the internal face of its bottom 22*b*. Pin 52 is inserted into the through axial cavity available in hub 50 and is locked, with its distal end, in a suited seat 54, which is obtained in hub 50. This allows axial hub 50 and, therefore, plug element 32 to be easily assembled and rotated around above-mentioned pin 52. In the embodiment shown, disc 46 and axial hub 50 are manufactured as one single piece, for example using a molded plastic material, thus forming a monolithic plug element 32.

In the embodiment shown, elastic thrust member 42 is axially mounted between disc 46 and bottom 22*b* of half-shell 12*b*. Preferably, the elastic thrust member 42 is peripherally fitted around axial hub 50.

Preferably, valve device 30 is provided with an electric operating system 56, adapted to control plug element 32. Thanks to the use of electric operating system 56, passage 28 (preferably in correspondence to orifice 34) can be freed/obstructed in a controlled manner according to the specific application and the context in which washing machine M has to work. For example, passage 28 can be differently freed/obstructed in a programmed manner through the different phases of the washing cycle of washing machine M. To this regard, by way of example, electric operating system 56 can be programmed to perform one or more of the following functions:

- order passage 28 to be at least partially freed only if, during the operation of machine M, the pressure inside washing chamber WC exceeds a predetermined threshold value; and/or
- order passage 28 to be obstructed only during those phases of the washing cycle in which one wants to prevent the vapor forming inside washing chamber WC from coming in contact with the environment outside of washing tub WT; and/or
- obstruct passage 28 when the environment inside washing tub WT has be isolated and not contaminated by the air have in the external environment.

In the embodiment shown, electric operating system 56 comprises an electric motor 58, for example a synchronous electric motor. Alternatively, electric actuators (not shown) can be used, which, unlike electric motor 58, which operates in a continuous and progressive manner, perform "discontinuous" and controlled actions by means of current impulses. To this regard, shape-memory conductor wires can be used as actuators adapted to contribute to the movement of plug element 32.

Preferably, electric operating system 56 comprises, furthermore, a reduction gear, which is caused to rotate by electric motor 58 and is kinematically connected to plug element 32. More preferably, gear 60 comprises a plurality of gear wheels 62, which mesh with one another and are interposed between electric motor 58 and plug element 32.

Preferably, electric operating system 56 comprises, furthermore, a printed circuit 64, which is configured to actuate electric motor 58, and a plurality of contacts 66, adapted to be connected to an external control unit (not shown), adapted to supply power and control signals to electric motor 58 through printed circuit 64.

In the embodiment shown, electric operating system 56 comprises, furthermore, a casing 68, which houses electric motor 58, reduction gear 60, printed circuit 64, and contacts 66. Preferably, casing 68 comprises two shaped tubs 68*a* and 68*b*, which are coupled to one another in correspondence to their periphery, for example by means of a snap-lock coupling.

In the embodiment shown, electric operating system 56 comprises, furthermore, a driving gear wheel 70, which kinematically connects gear 60 to plug element 32. Preferably, driving gear wheel 70 has an axial stem 72, which centrally ends in a top toothed disc 74.

For example, axial stem 72 is axially splined to one of gear wheels 62 and extends through a hole, which is obtained through the bottom of shaped tub 68*a*, and through another hole, which is obtained through bottom 22*b* of half-shell 12*b*. In this way axial stem 72 externally faces casing 68.

Preferably, top toothed disc 74 is arranged in hollow body 12 between half-shells 12*a* and 12*b*. More preferably, driving gear wheel 70 is supported and guided, during its rotation, by support projections, which are arranged on the internal faces of bottoms 22*a*, 22*b* of the respective half-shells 12*a*, 12*b* and cooperate with top toothed disc 74. Advantageously but not necessarily, top toothed disc 74 is housed in a narrow portion of hollow body 12, which is a hollow part in which the distance between the bottoms of half-shells 22*a* and 22*b* is reduced with respect to the rest of hollow body 12.

In the embodiment shown, a sealing gasket 76, for example an annular gasket of the "O-Ring" type, is axially mounted between the internal face of bottom 22*b* of half-shell 12*b* and driving gear wheel 70. Preferably, sealing gasket 76 is axially arranged between top toothed disc 74 and bottom 22*b* of half-shell 12*b*, for example in a depression or groove 77, which is conveniently obtained thereon. More preferably, sealing gasket 76 is peripherally fitted around axial stem 72.

In the embodiment shown, plug disc 46 is provided with an external toothing 78, which is kinematically connected to driving gear wheel 70. Preferably, external toothing 78 directly meshes with top toothed disc 74 of driving gear wheel 70. This allows a mechanical power transmission between electric motor 58 and plug element 32 to be obtained in an effective manner.

Advantageously but not necessarily, casing 68 has a thickness that is substantially analogous to that of hollow body 12. For example, casing 68 is mounted on hollow body in correspondence to a narrow portion of the latter. Preferably, the external face of shaped tub 68*a* is substantially coinciding for a first portion (for example in correspondence to driving gear wheel 70) on bottom 22*b* of half-shell 12*b*. In this way, the solution suggested by the present invention does not involve any thickness increase that may jeopardize component 10 in terms of space taken up with respect to similar components manufactured according to the prior art.

Naturally, the principle of the present invention being set forth, the embodiments and the implementation details can be widely changed with respect to what described above and shown in the drawings as a mere way of non-limiting example, without in this way going beyond the scope of protection provided by the accompanying claims.

To this regard, in the light of the present invention, a skilled person would clearly understand that the valve plug element can also be mounted in a different position with respect to the one in correspondence to the orifice and maintain its function of at least partially freeing and obstructing the passage.

For example, in less preferred embodiments (not shown), the valve device can be mounted on the hollow body in such a way that plug element operates so as to at least partially free and obstruct the hole instead of acting on the orifice. In these embodiments, the hole can preferably assume some of the advantageous features described above for the orifice, provided that they are compatible.

If necessary, a pair of valve devices can be installed, one of the valve devices having the plug element that is able to act on the orifice, while the other valve device has the respective plug element that is adapted to act on the hole.

The invention claimed is:

1. Component for feeding a pressurized liquid to a washing tub of a washing machine, in particular for a dishwasher; said component comprising a hollow body having:

at least one inlet configured to be connected to a source of pressurized liquid;

at least one outlet configured to deliver said liquid to a washing chamber defined by said washing tub; and a path for the liquid, which is defined in said hollow body between said at least one inlet and said at least one outlet and includes an air gap for preventing return of said pressurized liquid;

a passage adapted to establish a fluid communication between said washing chamber and an environment outside of said washing tub, through said hollow body, thus bringing the washing chamber and the environment outside of said washing tub to a pressure balance;

a valve device comprising:

a plug element which is mounted to be movable relative to said hollow body and is arranged to at least partially free and obstruct said passage; and an electric actuating system adapted to control said plug element;

said hollow body comprising a pair of shaped half-shells coupled to one another in a fluid-type arrangement;

said path being defined by a sequence of hollow spaces, the hollow spaces being positioned between pairs of ribs in said hollow body, the ribs forming continuous channeling on an inside of said hollow body; and said passage having an orifice in said half-shells in fluid communication between said hollow body and said washing chamber, and said passage having a hole in fluid communication between said hollow body and the environment outside of said washing tub, said plug element being adapted to at least partially free and obstruct said orifice or said hole.

2. The component according to claim 1, wherein said electric actuating system has a thickness that is substantially similar to the one of the hollow body.

3. The component according to claim 1, wherein said electric actuating system comprises an electric motor arranged to control movement of said plug element.

4. The component according to claim 3, wherein said electric actuating system comprises a gear which is operated by said electric motor and is kinematically connected to said plug element.

5. The component according to claim 1, wherein said plug element is mounted to be movable inside said hollow body.

6. The component according to claim 1, wherein said plug element is mounted to rotate with respect to said hollow body.

7. The component according to claim 6, wherein said plug element is axially held against said orifice or said hole by an elastic thrust member.

8. The component according to claim 6, wherein said orifice or said hole has at least one shaped opening substantially defining the shape of a circular sector.

9. The component according to claim 8, wherein the plug element comprises a disc having at least one slit which is associated to said at least one shaped opening and defines, in turn, a shape substantially matching said at least one shaped opening.

10. Washing machine comprising a washing tub, said washing tub defining in an interior washing chamber and a component according to claim 1;

wherein said at least one outlet is connected to said washing chamber;

wherein said orifice is in fluid communication with said washing chamber and the inside of said hollow body the environment outside of said washing tub.

11. The component according to claim 1, wherein said passage comprises a receptacle arranged between said orifice and said hole and forming a condensation chamber;

wherein when the pressure balance is exceeded in said washing chamber, vapor entering said washing chamber from said orifice flows out from said hole.

12. The component according to claim 1, wherein said electric operating system is programmable to perform at least one of the following functions:

order the passage to be at least partially free only if during operation of the machine, pressure inside said washing chamber exceeds a predetermined threshold value;

order the passage to be obstructed only during phases of a washing cycle in which vapor forming inside said washing chamber is prevented from contacting the environment outside of said washing tub;

obstruct the passage when an environment inside said washing tub is to be isolated and to prevent contamination by air of the environment outside of said washing tub.

* * * * *